US005487648A

United States Patent [19]

Alfano et al.

[11] Patent Number: 5,487,648

[45] Date of Patent: Jan. 30, 1996

[54] SHELL CONFIGURATION FOR A HERMETIC COMPRESSOR

[75] Inventors: Biagio Alfano, Milan; Edoardo Biscaldi, Saronno, both of Italy

[73] Assignee: Necchi Compressori S.r.l., Pavia, Italy

[21] Appl. No.: 310,309

[22] Filed: Jun. 22, 1994

[30] Foreign Application Priority Data

Nov. 12, 1993 [IT] Italy ..... PV93A0012

[51] Int. Cl.[6] ..... F04B 53/16

[52] U.S. Cl. ..... 417/312; 417/902; 62/508; 181/202

[58] Field of Search ..... 417/312, 902; 62/296, 508; 181/198, 200, 202

[56] References Cited

U.S. PATENT DOCUMENTS

| | | | |
|---|---|---|---|
| 2,928,589 | 3/1960 | Davey | 417/312 |
| 3,189,258 | 6/1965 | Larsen | 417/902 |
| 4,345,882 | 8/1982 | Saito et al. | 417/312 |
| 4,384,635 | 5/1983 | Lowery | 62/296 |
| 4,729,723 | 3/1988 | Outzen | 417/902 |
| 5,391,054 | 2/1995 | Bush | 417/902 |

FOREIGN PATENT DOCUMENTS

| | | | |
|---|---|---|---|
| 561385 | 9/1993 | European Pat. Off. | 417/902 |
| 109786 | 8/1980 | Japan | 417/312 |
| 6074153 | 3/1994 | Japan | 417/312 |

*Primary Examiner*—Richard A. Bertsch
*Assistant Examiner*—Roland G. Andrews, Jr.
*Attorney, Agent, or Firm*—Stevens, Davis, Miller & Mosher

[57] ABSTRACT

A hermetic motor compressor comprising a shell formed by an upper and a lower cap connected one to the other in such a way that an airtight closure is obtained in the shell, and by feet fixed to the lower cap for positioning the shell in the correct position during its working, the lower cap defining lower cap lateral surfaces having a very large curvature radius connected to first, second, third and fourth curved surfaces. First and second curved surfaces being connected to a lateral plane and third and fourth curved surfaces being connected one to the other, the lower cap defining a sphere-shape in a lower part thereof and a band in the upper part thereof which is joined to the upper cap.

8 Claims, 3 Drawing Sheets

SHELL CONFIGURATION FOR A HERMETIC COMPRESSOR

SUMMARY OF THE INVENTION

Hermetic compressor comprising a shell having a lower cap formed by lateral surfaces with a very large curvature radius, connected to curved surfaces and by a spherical surface in the lower part. The connection radii of the lateral surfaces with the curved surfaces are at least half of the height of the band located on the upper portion which is welded to the upper cap. The lateral surfaces continue in said upper cap which presents an asymmetric trilobate shape.

DESCRIPTION OF THE INVENTION

The present invention relates to a hermetic compressor comprising a shell formed by an upper and a lower cap connected one to the other in such a way that an airtight closure is obtained in the shell and by feet fixed the lower cap for positioning said compressor in the correct position during its working.

In the hermetic motor compressors for home refrigerators, beside the efficiency, a very important issue is the noise produced by the motor compressor and transmitted outside by the shell. It is known that for reducing the noise it is necessary to shape the shell in such a way that its resonance frequency is different from the frequency of the motor compressor. This is surely obtained when the resonance frequency of the shell is very high in comparison with the motor compressor frequency. The best result would reached with a sphere-shaped shell with a very small radius, but the structure of the motor compressor does not allow the use of so shaped shell. For improving the sound insulation of the shell, in the more recent art, asymmetries are operated on the upper cap equal to those operated on the lower cap for eliminating, among the vibration modes of the gaseus cavity contained in said caps, the modes characterized by symmetrical pressure wave. In such a way a reduction of the sound pressure level is obtained. Considering the fact that such compressors are used on home refrigerators, said reduction of the sound pressure level is not enough for removing the noise in said refrigerators during their working.

The technical problem to be solved was to provide a stiffer structure to the upper and the lower cap for obtaining a resonance frequency much higher than the compressor frequency, with walls positioned in such a way to vary the inner incidence angle of the sound waves, avoiding the perpendicular incidence.

The solution of the technical problem is characterized by the fact that the lower cap is formed by lateral surfaces with a very larg curvature radius, connected to curved surfaces, the first two of said curved surfaces being connected to a lateral plane and the second two connected one to the other, in the lower part said cap being sphere-shaped and in the upper part presenting a band which is joined to the upper cap, each of said lateral surfaces being connected to said first and to said second curved surface continuing on said upper cap.

Further characteristics and advantages will be more clearly apparent in the following description and drawings in which.

Figure 1:
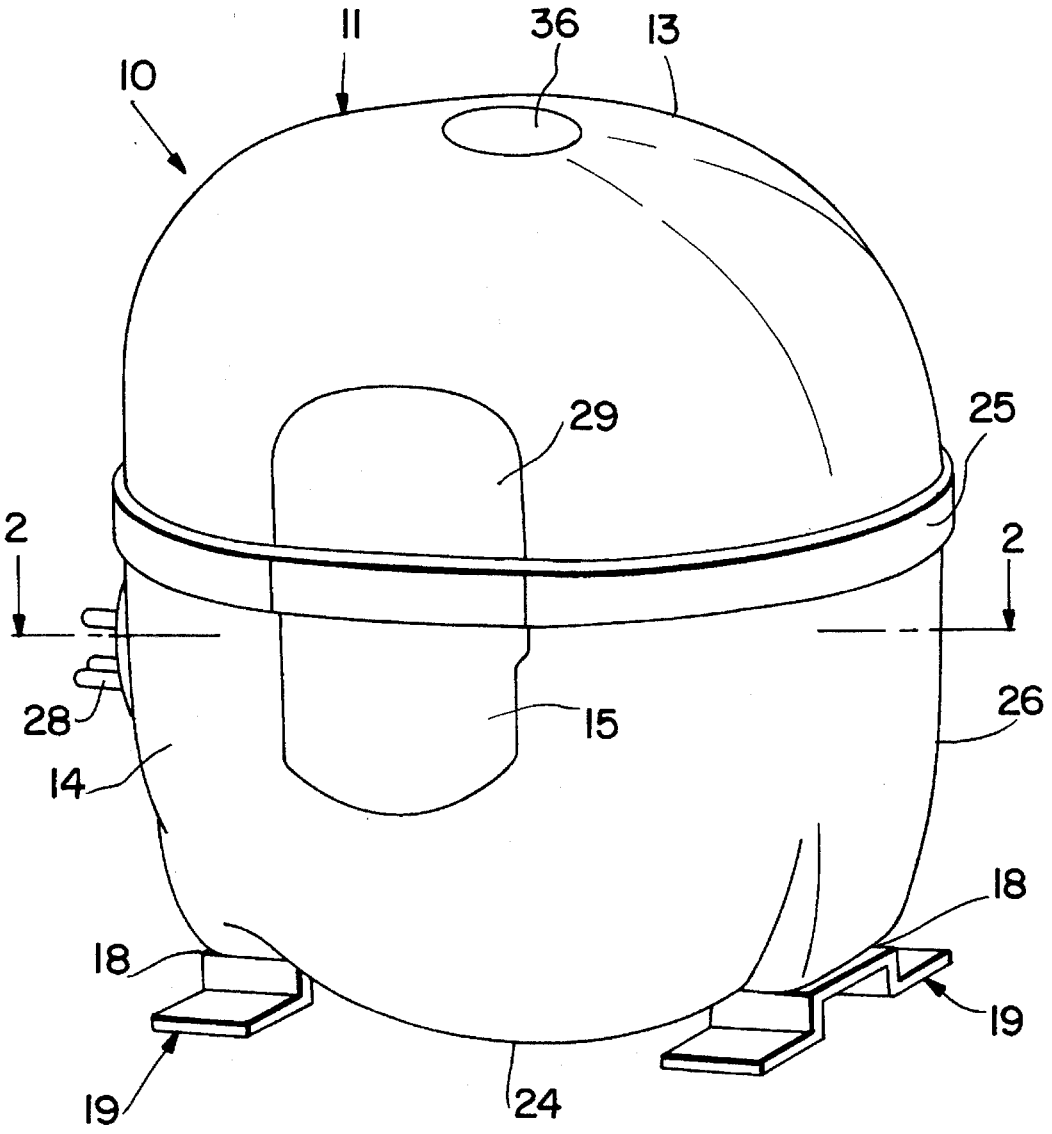
FIG. 1 is a perspective view of the shell object of the present invention.
Figure 3:
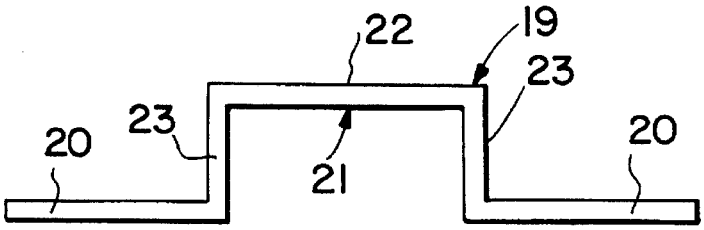
FIG. 3 shows a particular of FIG. 1.
Figure 2:
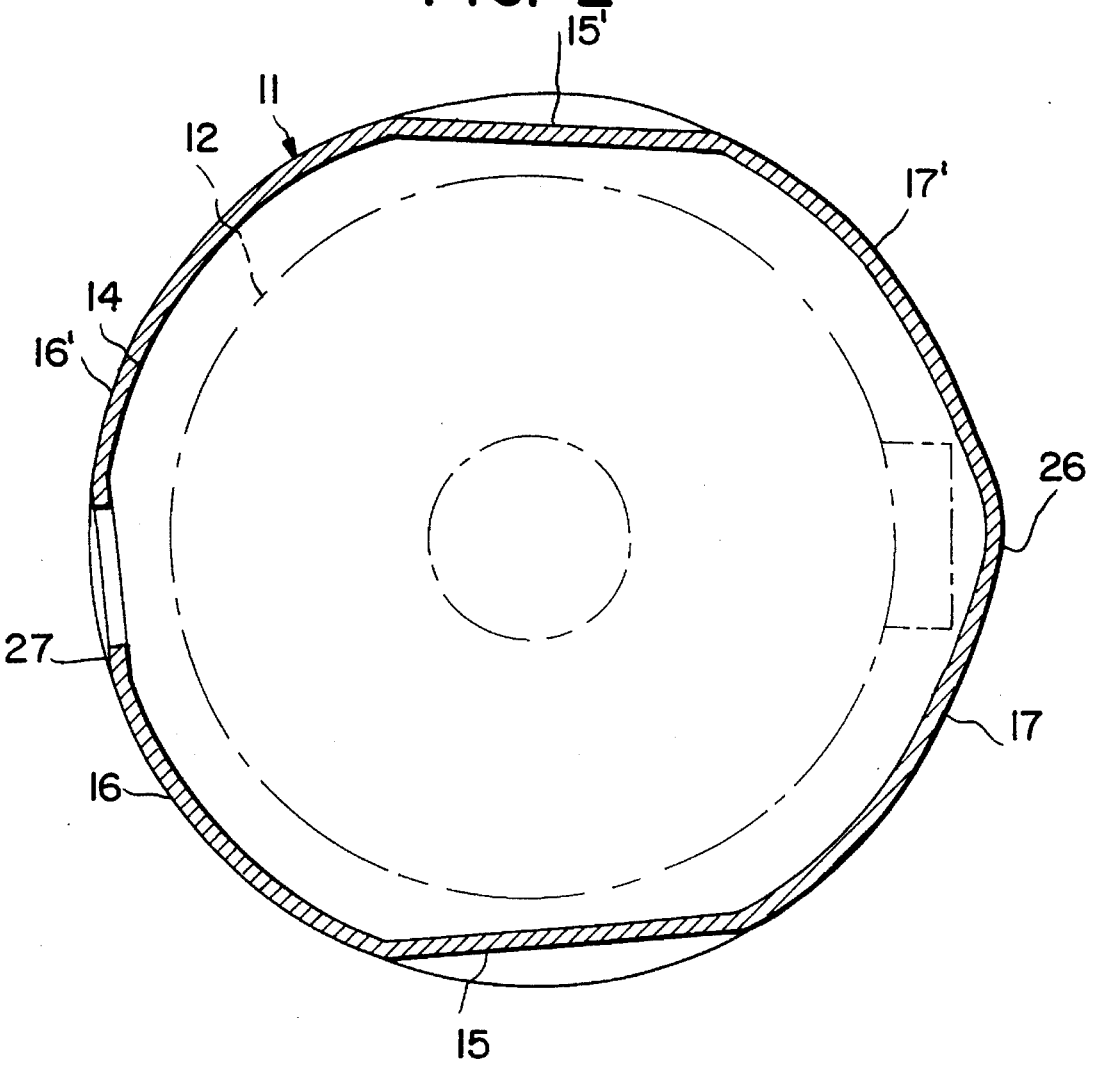
FIG. 2 is a section along the line 2—2 of FIG. 1.

With reference to FIGS. 1 and 2 it is generically indicated with 10 a motor compressor unit formed by a shell 11 and a compressor 12. The shell 11 is formed by an upper cap 13 and a lower cap 14. Said lower cap 14 presents lateral surfaces 15 and 15' connected (FIG. 2) respectively to curved surfaces 16–17 and 16'–17' presenting very small curvature radii, in order to reduce the vibration zone and at the same time to confer to the structure a certain rigidity almost as if ribs were on the inside of the cap 14. The lateral surfaces 15 and 15' (FIG. 2) are moreover inclined with reference to a horizontal axis for changing the inner incidence angle of the sound-waves, and therefore avoiding the sound-waves to strike perpendidicularly said lateral surfaces 15 and 15'. For strenghtening the lateral wall and obtaining a greater structural rigidity, the height of the band 25, which is welded to the upper cap has been increased. Such band must be in height at least twice the length of the radius connecting the lateral surfaces 15—15' with the curved surfaces 16—16' and 17—17'. Moreover the curved surfaces 17 and 17' are connected one the other with a very small radius so that a corner-edge 26 is nearly obtained.

The radius of said connection does of curved surfaces 17 and 17' not reach the double of the height of the band 25. A plane 27 has been made out between the curved surfaces 16 and 16'; said plane 27 interconnects to said surfaces 16 and 16' with very small curvature radii and is adopted to receive the electric connector 28. The plane 27 is inclined for varying the inner incidence angle of the sound-waves and for creating an asymmetry of sections. In the lower part, in the cap planes 18 (FIG. 1) have been made out, on which feet 19 are welded which are adopted to keep the shell 11 in its correct position during its use on the refrigerator. Each feet 19 is formed by two tongues 20 connected one to the other by a reversed U—shaped element 21. A botton plane 22, which connects vertical walls 23 of the element 21, is welded to the plane 18 of the cap 14. Such a conformation of the feet 19 absorbs the transversal vibrations of the shell 11. The botton 24 of the cap 14 presents a spherical shape with curvature radius small enough to create a resonance frequency of this zone much higher in comparison with that of the compressor 12.

The upper cap 13 presents a shape similar to an asymmetrical tribolate with its upper wall 36 flat. Two surfaces 29 and 29' are made out on the lateral portion of the cap 13 and are in correspondence with the lateral surfaces 15 and 15' respectively forming a continuation of these surfaces.

Figure 4:
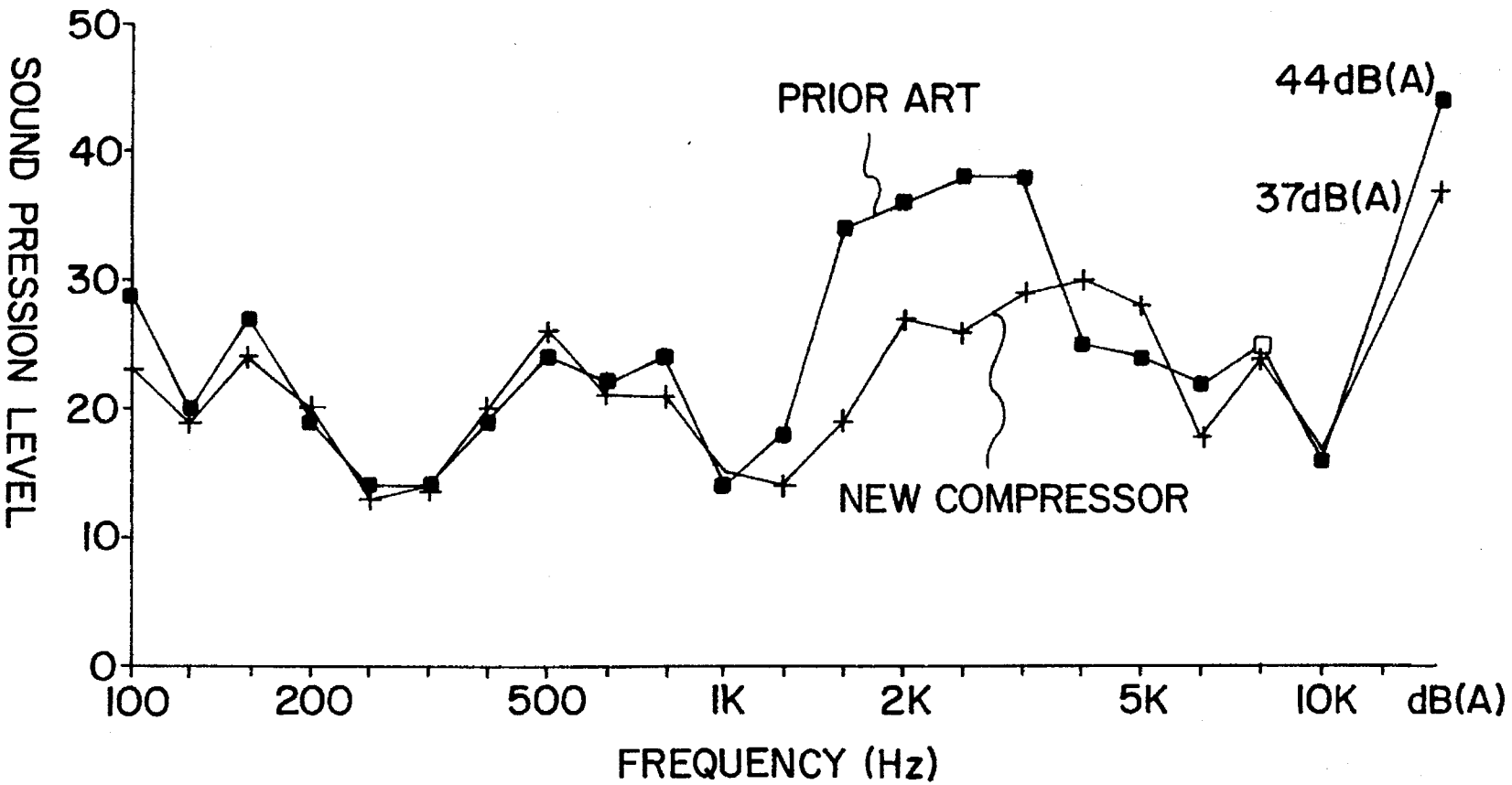
FIG. 4 is a diagram showing the noise levels of compressor known in the art and of a corresponding compressor object of the present invention.

The FIG. 4 is a graph relative to the sound pressure levels of a compressor mounted inside a traditional shell and of the same compressor mounted inside the new shell 11. From the graph it is possible to note that already near the 2000 Hz the noise level, the new shell is considerably lower than the one of the traditional shell; as total value in dB (A) we have 44 dB (A) for the traditional shell and 37 dB (A) for the new shell. A net profit of 7 dB(A) proves that with the rigid asymmetrical structure of the new shell 11 without influencing the inner volume of the shell, it possible to obtain a risonance frequency distant from that of the compressor reaching in this way the prefixed purpose.

We claim:

1. A hermetic motor compressor comprising a shell formed by an upper and a lower cap connected one to the other in such a way that an airtight closure is obtained in the shell, and by feet fixed to said lower cap for positioning said compressor in the correct position during its working, said lower cap defining non-flat opposing surfaces having a very large curvature radius in relation to a curvature radius of a circle circumscribing the largest cross-section of the lower cap connected to first, second, third and fourth curved surfaces, said first and second curved surfaces being connected to a flat surface and third and fourth curved surfaces being connected one to the other, said lower cap further defining a spherical-shape in a lower part thereof, and said upper cap defining a band on a lower part thereof to fit over an upper part of said lower cap.

2. The motor compressor according to claim 1 wherein said non-flat opposing surfaces of said lower cap are inclined relative to one another.

3. The motor compressor according to claim 1 wherein said band which is joined to said upper cap in height is at least twice the length of a radius connecting said flat surface to said first and second curved surfaces.

4. The motor compressor according to claim 1 wherein said third and fourth curved surfaces are connected one to the other to form an obtuse angle, said connection radius in length being less than double the height of said band.

5. The motor compressor according to claim 1 including an electric connector fixed on said flat surface.

6. The motor compressor according to claim 1, wherein said upper cap has a lower part of complementary configuration to the upper part of the lower cap and a flat upper wall.

7. A hermetic motor compressor comprising a shell formed by an upper and a lower cap connected one to the other in such a way that an airtight closure is obtained in the shell, and by feet fixed to said lower cap for positioning said compressor in the correct during its working, first and second curved surfaces being connected to a flat surface and opposing non-flat surfaces, and third and fourth curved surfaces being connected to each other and said opposing non-flat surfaces, a lower part of said lower cap defining horizontal surfaces on which said feet are fixed, said horizontal surfaces being connected one to the other by a spherical surfaces, said upper cap defining a band to fit over the upper part of the lower cap said upper cap defining opposing non-flat surfaces to create extensions of said opposing non-flat surfaces of said lower cap.

8. The motor compressor according to claim 7, wherein each of said feet is formed by two tongues connected one to the other by a reversed U shaped element, a top of said reversed U shaped element being fixed to one of said horizontal surfaces connected to said spherical shaped surface.

* * * * *